US009400111B2

(12) United States Patent
Kishida et al.

(10) Patent No.: US 9,400,111 B2
(45) Date of Patent: Jul. 26, 2016

(54) GAS TURBINE COMBUSTOR AND GAS TURBINE

(71) Applicant: MITSUBISHI HEAVY INDUSTRIES, LTD., Tokyo (JP)

(72) Inventors: Hiroaki Kishida, Tokyo (JP); Kentaro Tokuyama, Tokyo (JP); Takayoshi Takashima, Kanagawa (JP)

(73) Assignee: MITSUBISHI HITACHI POWER SYSTEMS, LTD., Kanagawa (JP)

( * ) Notice: Subject to any disclaimer, the term of this patent is extended or adjusted under 35 U.S.C. 154(b) by 400 days.

(21) Appl. No.: 14/158,032

(22) Filed: Jan. 17, 2014

(65) Prior Publication Data

US 2015/0204543 A1 Jul. 23, 2015

(51) Int. Cl.

| | |
|---|---|
| ***F23R 3/06*** | (2006.01) |
| ***F23R 3/00*** | (2006.01) |
| ***F23R 3/48*** | (2006.01) |

(52) U.S. Cl.

CPC . *F23R 3/06* (2013.01); *F23R 3/005* (2013.01); *F23R 3/48* (2013.01); *F23R 2900/00014* (2013.01); *F23R 2900/00017* (2013.01); *F23R 2900/00018* (2013.01); *F23R 2900/03043* (2013.01)

(58) Field of Classification Search

CPC ..... F23R 3/06; F23R 3/005; F23R 3/48; F23R 2900/00017; F23R 2900/00018; F23R 2900/00014; F23R 2900/03043

See application file for complete search history.

(56) References Cited

U.S. PATENT DOCUMENTS

2010/0132375 A1* 6/2010 Tanimura ..... F02C 7/222 60/796

FOREIGN PATENT DOCUMENTS

| | | |
|---|---|---|
| JP | 3-8590 | 1/1991 |
| JP | 5-44927 | 2/1993 |
| JP | 2003-56358 | 2/2003 |
| JP | 2010-281225 | 12/2010 |

OTHER PUBLICATIONS

Decision to grant a patent issued Aug. 15, 2013 in corresponding Japanese Application No. 2011-151309 (with English translation).

* cited by examiner

*Primary Examiner* — Moshe Wilensky

(74) *Attorney, Agent, or Firm* — Wenderoth, Lind & Ponack, L.L.P.

(57) ABSTRACT

A gas turbine combustor is disposed in a casing interior space of a gas turbine. A combustor basket of the combustor is formed into a cylindrical shape by abutting ends of a curved panel member and welding the ends together along a welding line 16. A communication tube is provided for communication between an interior space of the combustor basket and an interior space of a combustor basket of an adjacent combustor. The position of the welding line of the combustor basket coincides with a connection position for connecting the communication tube to the combustor basket. A cooling air hole is disposed in the communication tube or in the combustor basket in the vicinity of the communication tube to introduce cooling air from the casing interior space 9 to the interior of the combustor basket.

3 Claims, 5 Drawing Sheets

GAS TURBINE COMBUSTOR AND GAS TURBINE

TECHNICAL FIELD

The present invention relates to a gas turbine combustor which is housed in a casing of a gas turbine and generates combustion gas, and also to a gas turbine using this gas turbine combustor.

BACKGROUND ART

A gas turbine combustor is exposed to a high-temperature harsh environment. Thus, it has been known to use, as a component of the gas turbine combustor, a cylindrical member in which a plurality of passages for feeding a cooling medium is formed.

For instance, described in Patent Document 1 is a combustor basket of a gas turbine combustor. In the combustor basket of the gas turbine combustor, a plurality of air flow grooves where air flows as a cooling medium is formed.

A combustor basket of a gas turbine combustor is typically formed by curving a panel member having therein channels where a cooling medium flows, abutting ends of the curved panel member, and welding them together into a cylindrical shape.

For instance, in Patent Document 2, it is described that a panel member having a plurality of fins on its surface is joined to another panel member to form a panel member with spaces between adjacent fins which serve as channels for a cooling medium, and then this panel member is curved by cold press forming.

Further, in Patent Document 3, it is described that when making a combustor basket composed of a plurality of combustor basket rings and a wave-like panel ring which is welded between adjacent combustor basket rings, the combustor basket rings and the wave-like panel rings are formed into a pair of semi cylindrical objects and this pair of semi cylindrical objects is welded together along a welding line.

CITATION LIST

Patent Document

[Patent Document 1]
JP 5-44927 A
[Patent Document 2]
JP 2010-281225 A
[Patent Document 3]
JP 3-8590 A

SUMMARY

Technical Problem

A conventional gas turbine combustor is cooled by feeding a cooling medium such as air and steam into a channel formed inside a combustor basket and thus, it is capable of withstanding a high-temperature harsh environment. However, in recent years, combustion temperatures have been increasing with the objective of increasing the efficiency. Therefore, it is desired to develop a gas turbine combustor with high reliability, which can withstand a harsher environment.

As a result of intensive studies aimed at responding to such expectations, it has been found by the present inventors that the periphery of the welding line where channels for cooling medium to flow through cannot be formed is not sufficiently cooled compared to other sections and a metal temperature in the periphery of the welding line increases to cause damage such as generation of cracks.

In this respect, none of Patent Documents 1 to 3 discloses how to enhance cooling effect in the periphery of the welding line of the combustor basket.

In view of the above issues, it is an object of the present invention to provide a gas turbine combustor which enhances cooling effect in the periphery of the welding line of the combustor basket, as well as a gas turbine equipped with this gas turbine combustor.

Solution to Problem

A gas turbine combustor according to at least one embodiment of the present invention is arranged in an interior space of a casing of a gas turbine, and comprises:

a tubular member which is formed by abutting ends of a curved panel member and welding the ends together along a welding line, and has an interior where combustion gas flows; and a communication tube configured to connect the interior space of the tubular member to the interior space of another tubular member of an adjacent combustor, wherein a position of the welding line coincides with a connection position for connecting the communication tube to the tubular member, and a cooling air hole is provided in either the communication tube or the tubular member in a vicinity of the communication tube so as to introduce cooling air from the interior space of the casing to the interior of the tubular member.

In this gas turbine combustor, the cooling air hole is provided in either the communication tube or the tubular member in a vicinity of the communication tube. Therefore, the cooling air introduced from the casing interior space via the cooling air hole enters the interior space of the tubular member and flows downstream in the flow direction of the combustion gas along an inner wall surface of the tubular member in a film-like fashion. Herein, the position of the welding line coincides with the connection position for connecting the communication tube to the tubular member. Thus, the inner wall surface of the tubular member around the welding line is blocked by the cooling air which flows downstream in the flow direction of the combustion gas in a film-like fashion, and hence is not directly exposed to high temperature combustion gas. In this manner, it is possible to suppress increase in a metal temperature of the tubular member around the welding line, mainly by film cooling.

The above gas turbine combustor preferably further comprises a resonance device disposed on an outer surface of the tubular member in such a manner as to avoid the welding line.

As the resonance device is disposed in such a manner as to avoid the welding line, the area of the tubular member around the welding line is directly exposed to the casing interior space. Compared to the case where the welding line is covered by the resonance device, heat release is promoted from the area of the tubular member around the welding line to the casing interior space, thereby achieving a larger cooling effect.

A gas turbine according to at least one embodiment of the present invention comprises:

the gas turbine combustor described above;

a casing configured to accommodate the gas turbine combustor;

a compressor which is accommodated in the casing and is configured to supply compressed air as combustion air to the gas turbine combustor via the interior space of the casing; and a turbine which is accommodated in the casing and is configured to be driven by the combustion gas generated in the gas turbine combustor, wherein the compressed air partially enters the interior of the tubular member as cooling air via the cooling air hole.

According to this gas turbine, a part of the compressed air produced in the compressor enters the interior space of the tubular member from the casing interior space via the cooling air hole and flows along the inner wall surface of the tubular member around the welding line in a film-like fashion. Therefore, it is possible to suppress increase in a metal temperature of the tubular member around the welding line.

Advantageous Effects

According to the present invention, the cooling air hole is provided in either the communication tube or the tubular member in a vicinity of the communication tube. Therefore, the cooling air introduced from the casing interior space via the cooling air hole enters the interior space of the tubular member and flows downstream in the flow direction of the combustion gas along the inner wall surface of the tubular member in a film-like fashion. Herein, the position of the welding line coincides with the connection position for connecting the communication tube to the tubular member. Thus, the inner wall surface of the tubular member around the welding line is blocked by the cooling air which flows like a film toward a downstream side in the flow direction of the combustion gas, and hence is not directly exposed to high temperature combustion gas. In this manner, it is possible to suppress increase in a metal temperature of the tubular member around the welding line, mainly by film cooling.

DETAILED DESCRIPTION

An embodiment of the present invention will now be described in detail with reference to the accompanying drawings. It is intended, however, that unless particularly specified, dimensions, materials, shapes, relative positions and the like of components described in the embodiment shall be interpreted as illustrative only and not limitative of the scope of the present invention.

Figure 1:
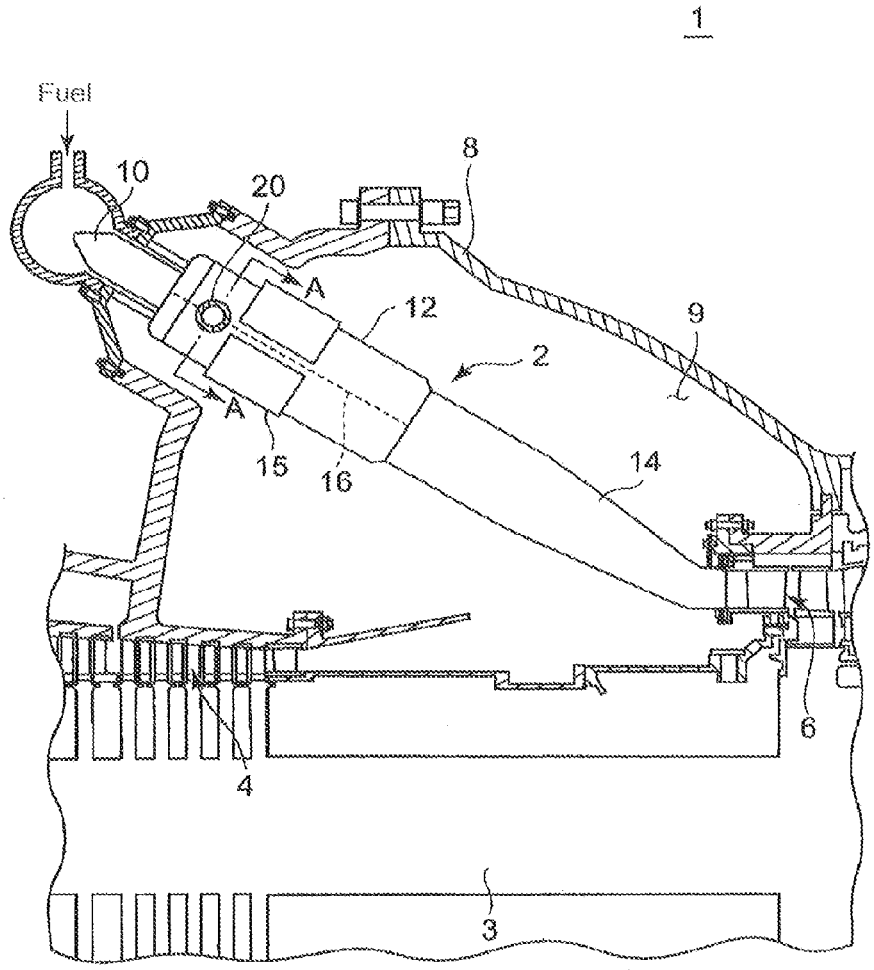
FIG. 1 is a cross-sectional view of a configuration example of a gas turbine.
Figure 2:
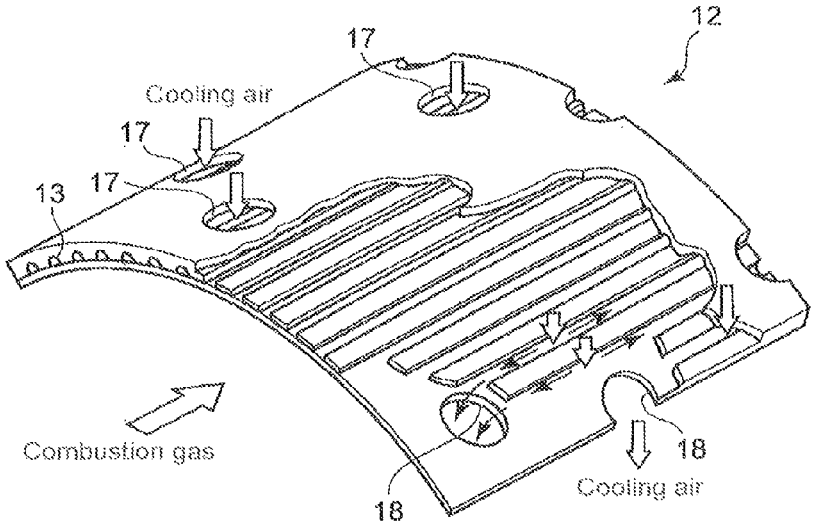
FIG. 2 is an illustration of a detailed structure of a combustor basket of a gas turbine combustor.
Figure 3:
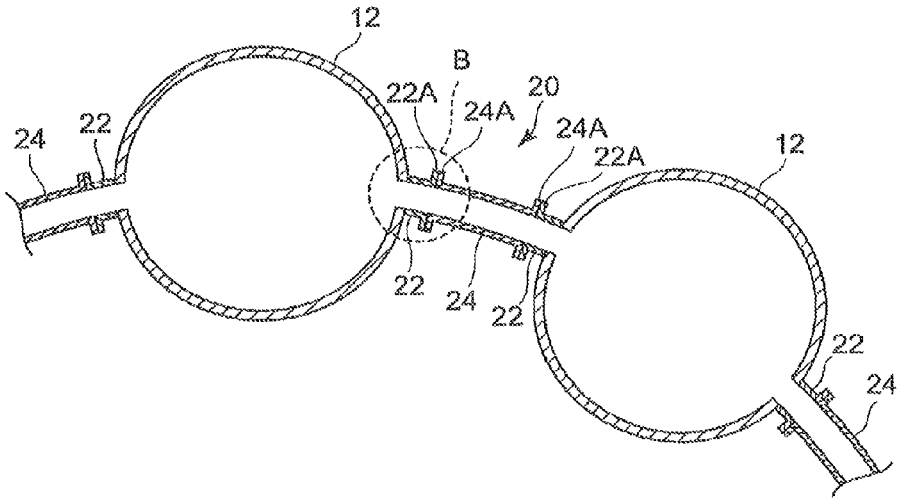
FIG. 3 is a cross-sectional view along line A-A of FIG. 1.
Figure 4:
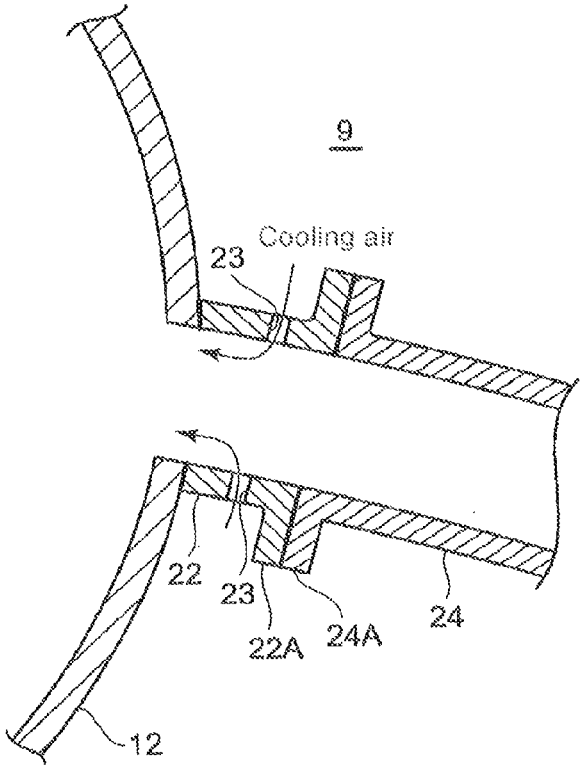
FIG. 4 is an enlarged view of section B of FIG. 3.
Figure 5:
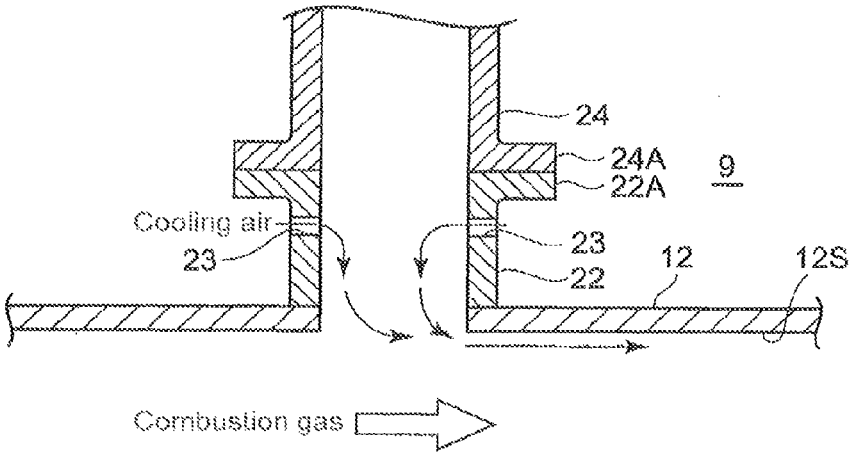
FIG. 5 is an illustration of a flow of cooling air in the combustor basket of the gas turbine combustor around a communication tube.

FIG. 1 is a cross-sectional view of a configuration example of a gas turbine. FIG. 2 is an illustration of a detailed structure of a combustor basket (tubular member) of a gas turbine combustor. FIG. 3 is a cross-sectional view along line A-A of FIG. 1. FIG. 4 is an enlarged view of section B of FIG. 3. FIG. 5 is an illustration of a flow of cooling air in the combustor basket of the gas turbine combustor around a communication tube.

As illustrated in FIG. 1, a gas turbine 1 is configured by a gas turbine combustor (hereinafter, simply referred to as "combustor") 2, a compressor 4 and a turbine 6. The combustor 2 is accommodated in a substantially annular casing interior space 9 formed around a rotor 3 by a casing 8 at a position between the compressor 4 and the turbine 6. Although only one combustor 2 is illustrated in FIG. 1, there is actually a plurality of combustors 2 arranged in the circumferential direction of the rotor 3.

Each of the combustors 2 comprises a nozzle 10 for injecting fuel, a combustor basket (combustor liner) 12 where the fuel injected from the nozzle 10 is combusted, and a transition piece 14 for leading the combustion gas generated in the combustor basket 12 toward the turbine 6.

The combustor basket 12 is, as described later in details, formed into a cylindrical shape by abutting ends of a curved panel member to each other and plasma-welding them together along a welding line 16. Inside a wall of the combustor basket 12, a plurality of channels 13 is formed, extending along a flow direction of the combustion gas in an interior of the combustor basket 12 as illustrated in FIG. 2. Further, a cooling air inlet 17 is disposed on an outer surface of the combustor basket 12, and a cooling air outlet 18 is disposed on an inner surface of the combustor basket 12. Each of the channels 13 communicates with the cooling air inlet 17 and the cooling air outlet 18. As a result, the cooling air from the casing interior space 9 is introduced to each of the channels 13 through the cooling air inlet 17, and after flowing in the channel 13, the cooling air is discharged to the interior space of the combustor basket 12 from the cooling air outlet 18.

Further, a resonance device (also called an acoustic liner) 15 is attached to the outer surface of the combustor basket 12 to reduce combustion oscillation. This resonance device 15 is arranged in such a manner as to avoid the welding line 16.

Specifically, the resonance device 15 is disposed over substantially the entire circumference of the combustor basket 12 but not in a region around the welding line 16. Therefore, the periphery of the welding line 16 of the combustor basket 12 is directly exposed to the casing interior space 9. This promotes heat release from the periphery of the welding line 16 of the combustor basket 12 to the casing interior space 9.

As illustrated in FIG. 3, the combustor baskets 12 of adjacent combustors 2 are connected by a communication tube 20. The communication tube 20 comprises a cross-flame short tube 22 attached to the outer surface of the combustor basket 12 by welding, and a cross-flame tube 24 disposed between the cross-flame short tube 22 and a cross-flame short tube 22 of a combustor basket 12 of the adjacent combustor 2. The cross-flame short tube 22 and the cross-flame tube 24 are connected to each other by fastening respective flanges 22A and 24A by an arbitrary fastening member.

By connecting the combustor baskets 12 of the adjacent combustors 2 by the communication tube 20, the interior spaces of the combustor baskets 12 of the adjacent combustors 2 communicate with each other.

As illustrated in FIG. 4, a plurality of cooling air holes 23 is provided in the cross-flame short tube 22 of the communication tube 20. As a result, a part of the compressed air produced in the compressor 4 is introduced to the interior of the cross-flame short tube 22 as cooling air through the cooling air hole 23 from the casing interior space 9. The shape, size, number, position, or the like of the cooling air hole 23 is not particularly limited, and is preferably set according to an amount of cooling air to be introduced to the interior of the communication tube 20 via the cooling air hole 23.

Then, the cooling air introduced to the interior of the cross-flame short tube 22 is thereafter introduced to the interior of the combustor basket 12 as illustrated in FIG. 5. This cooling air flows likes a film toward a downstream side in the flow direction of the combustion gas along an inner wall surface 12S of the combustor basket 12.

In this embodiment, a position of the welding line 16 of the combustor basket 12 (see FIG. 1) coincides with a connection position for connecting the communication tube 20 (specifically, the cross-flame short tube 22) to the combustor basket 12. The combustor basket 12 having this configuration may be produced in the following manner.

Figure 6A:
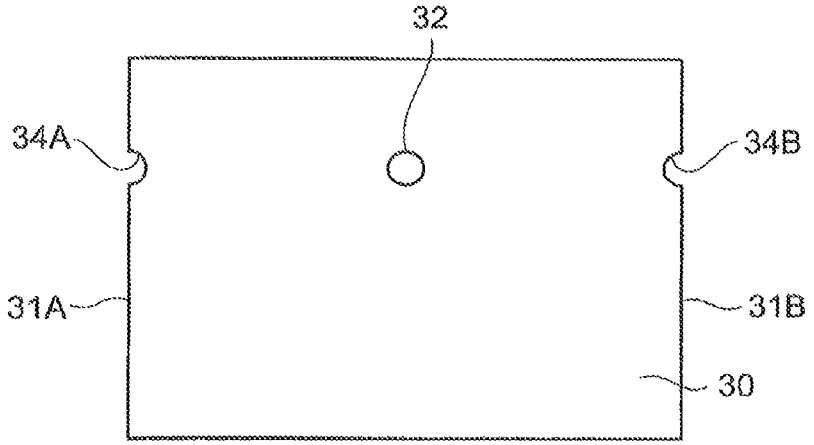
FIG. 6A is a plan view of a flat panel member before forming, illustrating production of the combustor basket of the gas turbine combustor.
Figure 6B:
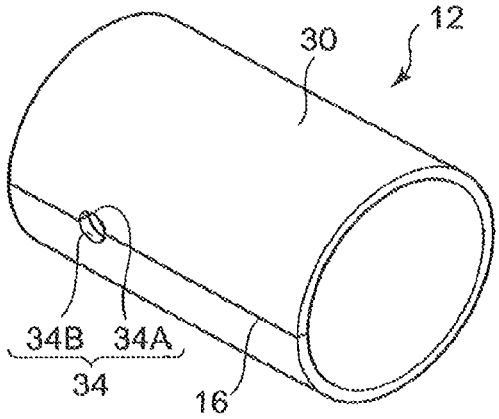
FIG. 6B is an oblique view of the combustor basket obtained by forming the panel member into a curved shape and then welding it, to illustrate the production of the combustor basket of the gas turbine combustor.

FIG. 6A and FIG. 6B illustrate production of the combustor basket 12. FIG. 6A is a plan view of the flat panel member before forming. FIG. 6B is an oblique view of the combustor basket 12 obtained by forming the panel member into a curved shape and then welding it.

As illustrated in FIG. 6A, the panel member 30 before forming has a flat panel shape. In the panel member 30, an opening 32 is formed at the connection positions to one of the cross-flame short tubes 22, and notches of a semicircular shape (34A, 34B) are provided to later form an opening 34 at the connection positions to the other of the cross-flame short tubes 22. Further, in the panel member 30, the channels 13, the cooling air inlets 17 and the cooling air outlets 18 as illustrated in FIG. 2 are formed.

By forming the panel member 30 into a cylindrical shape by press-forming, abutting ends (31A, 31B) of the panel member 30 to each other, and then welding them along the welding line 16 by plasma welding, the combustor basket 12 illustrated in FIG. 6B can be obtained. Finally, to the positions of the openings 32 and 34 of the combustor basket 12, the cross-flame short tubes 22 are attached by welding. As a result, it is possible to obtain the combustor basket 12 configured such that the position of the welding line 16 coincides with the connection position for connecting the cross-flame short tube 22 to the combustor basket 12 (i.e. the position of the opening 34).

As described above, in this embodiment, the cooling air hole 23 is provided in the communication tube 20 (specifically, cross-flame short tube 22) and thus, the cooling air introduced to the communication tube 20 from the casing interior space 9 via the cooling air hole 23 enters the interior space of the combustor basket 12 and flows downstream in the flow direction of the combustion gas along the inner wall surface 12S of the combustor basket 12 in a film-like manner. Herein, the position of the welding line 16 coincides with the connection position for connecting the communication tube 20 (specifically, the cross-flame short tube 22) to the combustor basket 12 (i.e. the position of the opening 34). Thus, the inner wall surface 12S of the combustor basket 12 around the welding line 16 is blocked by the cooling air which flows like a film downstream in the flow direction of the combustion gas, and hence is not directly exposed to the high temperature combustion gas. In this manner, it is possible to suppress increase in a metal temperature of the combustor basket 12 around the welding line 16 mainly by film cooling.

Further, the resonance device 15 attached to the outer surface of the combustor basket 12 is disposed in such a manner as to avoid the welding line 16. Thus, the area of the combustor basket 12 around the welding line 16 is directly exposed to the casing interior space 9. Compared to the case where the welding line 16 is covered by the resonance device 15, heat release is promoted from the area of the combustor basket 12 around the welding line 16 to the casing interior space 9, thereby achieving a larger cooling effect.

Furthermore, the cooling air having leaked from between flange joining faces of the cross-flame short tube 22 and the cross-flame tube 24 serves to cool an outer wall surface of the combustor basket 12 around the cross-flame short tube 22. Therefore, the area of the combustor basket 12 around the welding line 16 can be cooled more reliably.

While the embodiment of the present invention have been described, it is obvious to those skilled in the art that various changes may be made without departing from the scope of the invention.

Figure 7:
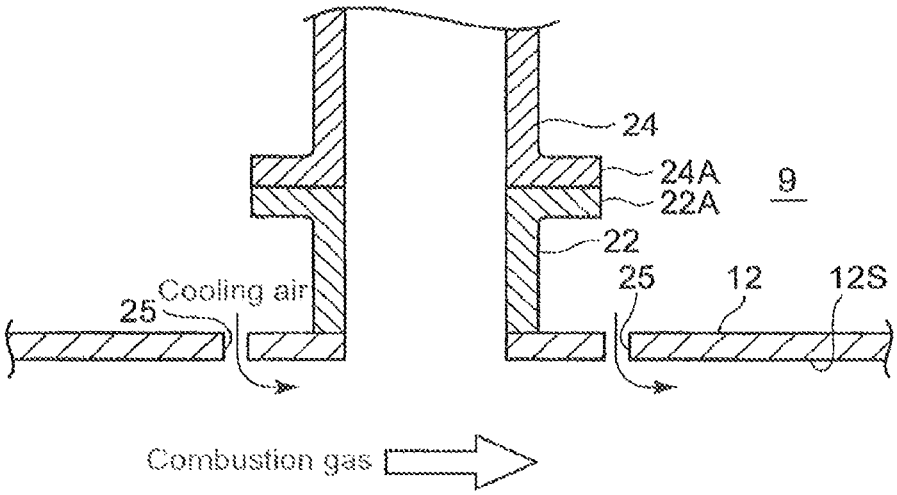
FIG. 7 is an illustration of a flow of cooling air in the case where a cooling air hole is provided in the combustor basket of the gas turbine combustor in the vicinity of the communication tube.

For instance, in the above embodiment, the cooling air hole 23 for introducing the cooling air to the interior space of the combustor basket 12 is provided in the communication tube 20 (specifically, the cross-flame short tube 22). This is, however, not restrictive and the cooling air hole may be provided in the combustor basket 12 in the vicinity of the cross-flame short tube 22. FIG. 7 is an illustration of a flow of the cooling air around the communication tube 20 in the case where the cooling air hole is provided in the vicinity of the cross-flame short tube 22.

As illustrated in FIG. 7, in the vicinity of the cross-flame short tube 22, a cooling air hole 25 is provided. As a result, similarly to the above described embodiment, the cooling air introduced to the interior of the combustor basket 12 from the cooling air hole 25 flows downstream in the flow direction of the combustion gas along the inner wall surface 12S of the combustor basket 12 in a film-like fashion. Therefore, the inner wall 12S of the combustor basket 12 around the welding line 16 is blocked by the cooling air which flows downstream in the flow direction of the combustion gas in a film-like fashion, and hence is not directly exposed to the high temperature combustion gas.

The shape, size, number, position, or the like of the cooling air hole 25 is not particularly limited, and is preferably set according to an amount of cooling air to be introduced to the interior of the combustor basket 12 via the cooling air hole 25.

In the above-described embodiment, the combustor basket 12 is provided with the plurality of channels 13 extending along the flow direction of the combustion gas. This, however, does not limit the configuration of the combustor basket 12 as long as the welding line 16 of the combustor basket 12 coincides with the connection position for connecting the communication tube 20 to the combustor basket 12. For instance, the combustor basket 12 may be configured such that the channels 13 are oblique to the flow direction of the combustion gas or such that the channels 13 are bent or curved.

Moreover, in the above-described embodiment, one panel member 30 is formed into a cylindrical shape and then both ends (31A, 31B) of the panel member 30 are abutted and welded together to obtain the combustor basket 12. This is, however, not restrictive and more than one panel member 30 may be used to produce the combustor basket 12.

For instance, the combustor basket 12 of a cylindrical shape may be produced by forming two panel members into a curved shape (a semi-circular sectional shape) and then abutting and welding their ends. In this case, there are two welding lines 16 in the combustor basket 12 and thus, a position of each of the welding lines 16 is preferably arranged to coincide with the connection position for connecting the corresponding communication tube 20 to the combustor basket 12. As a result, it is possible to enhance the cooling effect of the combustor basket 12 around each of the welding lines 16.

Lastly, it has been described in the above-described embodiment to cool the combustor basket 12 around the welding line 16. However, the present invention can be widely used to cool the periphery of a welding line of a tubular member in which combustion gas flows and which is formed by abutting ends of a curved panel member and welding the ends along the welding line. For instance, in the case where the transition piece 14 is formed by abutting ends of a curved panel member and welding the ends along the welding line, the present invention is applicable to cooling of the periphery of the welding line of the transition piece 14.

REFERENCE SIGNS LIST

1 Gas turbine
2 Combustor
3 Rotor
4 Compressor
6 Turbine
8 Casing
9 Casing interior space
10 Nozzle
12 Combustor basket (Tubular member)
12S Inner wall surface
13 Channel
14 Transition piece
15 Resonance device
16 Welding line
17 Cooling air inlet
18 Cooling air outlet
20 Communication tube
22 Cross-flame short tube
22A Flange
23 Cooling air hole
24 Cross-flame tube
25 Cooling air hole
24A Flange
30 Panel member
31A End
31B End
32 Opening
34 Opening
34A Notch
34B Notch

The invention claimed is:

1. A gas turbine combustor which is arranged in an interior space of a casing of a gas turbine, the combustor comprising:

a first tubular member which is formed by abutting ends of a curved panel member and welding the ends together along a welding line, and has an interior where combustion gas flows; and a communication tube configured to connect the interior space of the first tubular member to the interior space of a second tubular member of an adjacent combustor, wherein a position of the welding line coincides with a connection position for connecting the communication tube to the first tubular member, and a cooling air hole is provided in at least the communication tube so as to introduce cooling air from the interior space of the casing to the interior of the first tubular member.

2. The gas turbine combustor according to claim 1, further comprising:

a resonance device disposed on an outer surface of the first tubular member in such a manner as to avoid the welding line.

3. A gas turbine comprising:

the gas turbine combustor described in claim 1;

a casing configured to accommodate the gas turbine combustor;

a compressor which is accommodated in the casing and is configured to supply compressed air as combustion air to the gas turbine combustor via the interior space of the casing; and a turbine which is accommodated in the casing and is configured to be driven by the combustion gas generated in the gas turbine combustor, wherein the compressed air partially enters the interior of the first tubular member as cooling air via the cooling air hole.

* * * * *